United States Patent [19]

Rogerson

[11] 4,184,675

[45] Jan. 22, 1980

[54] MECHANICAL ARM WRESTLER

[76] Inventor: Brent Rogerson, R.D. #1, Box 47, Lake Lynn, Pa. 15451

[21] Appl. No.: 837,337

[22] Filed: Sep. 28, 1977

Related U.S. Application Data

[63] Continuation of Ser. No. 732,840, Oct. 18, 1976, abandoned.

[51] Int. Cl.[2] ..... A63B 21/00

[52] U.S. Cl. ..... 272/67; 272/130; 272/143; 272/DIG. 5

[58] Field of Search ..... 272/130, 143, DIG. 1, 272/DIG. 5, DIG. 4, 116, 72, 67, 68; 137/505.11, 455; 128/25 R

[56] References Cited

U.S. PATENT DOCUMENTS

| | | | |
|---|---|---|---|
| 929,281 | 7/1909 | Brodeur | 73/381 |
| 948,140 | 2/1910 | Johnson | 73/381 |
| 1,015,071 | 1/1912 | Reach | 272/72 |
| 2,819,728 | 1/1958 | Gage et al. | 137/505.11 |
| 3,059,476 | 10/1962 | Spradlin | 73/380 |
| 3,369,403 | 2/1968 | Carlin et al. | 272/130 X |
| 3,400,793 | 9/1968 | Morris et al. | 272/129 X |
| 3,495,824 | 2/1970 | Cuinier | 272/130 |
| 3,563,542 | 2/1971 | Wellman | 272/135 |
| 3,662,602 | 5/1972 | Weiss | 73/381 R |
| 3,822,599 | 7/1974 | Brentham | 272/130 X |
| 3,912,265 | 10/1975 | Muir | 272/130 |
| 3,938,389 | 2/1976 | Kella | 73/381 |

*Primary Examiner*—Richard C. Pinkham
*Assistant Examiner*—William R. Browne
*Attorney, Agent, or Firm*—Snider, Sterne & Saidman

[57] ABSTRACT

A mechanical arm wrestler for arm wrestling against a mechanical arm having a strength variable at will is disclosed. The arm wrestler comprises a base, a fluid cylinder mounted on the base, a crank arm pivotably mounted on the base, a rod pivotably connecting the crank arm to the rod of the fluid cylinder, a latch for releasably holding the crank arm in the ready condition, an air pump and pressure meter for providing a preselected pressure in the fluid cylinder, and toggles mounted on the crank arm which actuate a dump valve when either the mechanical arm wrestler or the individual wrestling against it has won the game.

14 Claims, 7 Drawing Figures

MECHANICAL ARM WRESTLER

This is a continuation of application Ser. No. 732,840, filed Oct. 18, 1976.

FIELD OF THE INVENTION

This invention relates to games and/or exercising devices, since it is usable either purely for pleasure or as an arm muscle exerciser.

SUMMARY OF THE INVENTION

The invention is a mechanical arm wrestler allowing the user thereof to wrestle against a mechanical arm having a strength variable at will. The arm wrestler comprises a base, a fluid cylinder mounted on the base, a crank arm pivotably mounted on the base, a rod pivotably connecting the crank arm to the rod of the fluid cylinder, first means for releasably holding the crank arm in the ready condition, second means for providing a preselected pressure in the fluid cylinder, and third means for venting the fluid in the cylinder when either the mechanical arm wrestler or the individual wrestling against it has won the game.

DETAILED DESCRIPTION OF THE PRESENTLY PREFERRED EMBODIMENT

Figure 1:
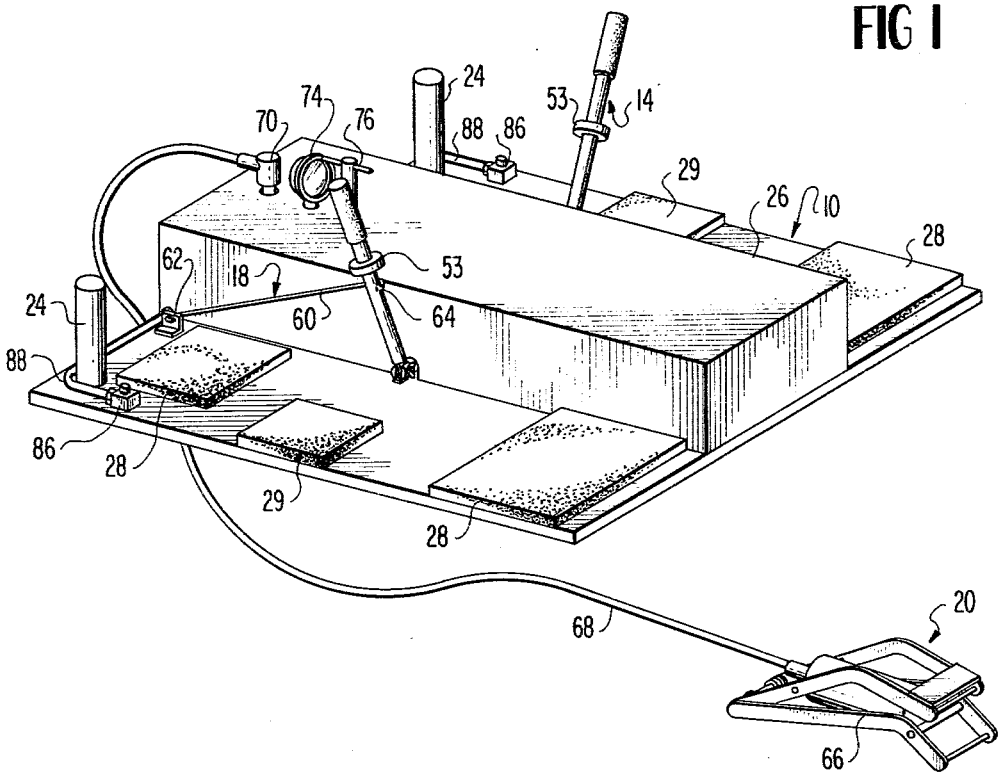
FIG. 1 is a perspective view of a mechanical arm wrestler according to this invention.

The mechanical arm wrestler shown in the drawings broadly comprises a base 10, an air cylinder 12 mounted on the base 10, a crank arm 14 pivotably mounted on the base 10, two rods 16 pivotably connecting the crank arm 14 to the air cylinder 12, means 18 for releasably holding the crank arm 14 in the ready condition, means 20 for providing a preselected air pressure in the air cylinder 12, and means 22 for venting the air in the air cylinder 12 when the crank arm 14 has pivoted from its ready condition by a pre-determined amount. Each of the foregoing elements will be further described subsequently herein in appropriate detail.

The exact shape and composition of the base 10 is completely non-critical to the invention. Its function is merely to hold the other elements of the arm wrestler in appropriate spatial relationship, and it can conveniently be separately supplied by the end user rather than supplied with the other elements. However, the illustrated base 10 is particularly appropriate when the arm wrestler is sold for home use, since it can easily be set down on top of a rumpus room table whenever it is desired to use the device. In this embodiment, the base 10 is provided with integral bracing posts 24 for grasping by the user's free hand, with a removable cover 26 preventing inadvertent contact with the working parts of the arm wrestler, with resilient pads 28 positioned to protect the hand of a user of the arm wrestler at either extremity of the travel of the crank arm 14, and with resilient pads 29 positioned to protect the user's elbow.

The air cylinder 12 has a piston 30 therein and a rod 32 carried by the piston 30 and extending from one end of the cylinder 12. The dimensions of the compartments of the air cylinder and of the crank arm 14 and the rods 16 are preferably chosen so that the linear extremities of the travel of the rod 32 correspond to the angular extremities of the travel of the crank arm 14. Such air cylinder are readily available commercially, and accordingly the air cylinder 12 will not be described herein in further detail. Of course, the air cylinder 12 could be replaced by any other type of fluid cylinder with appropriate adjustments in the other components of the arm wrestler.

Figure 6:
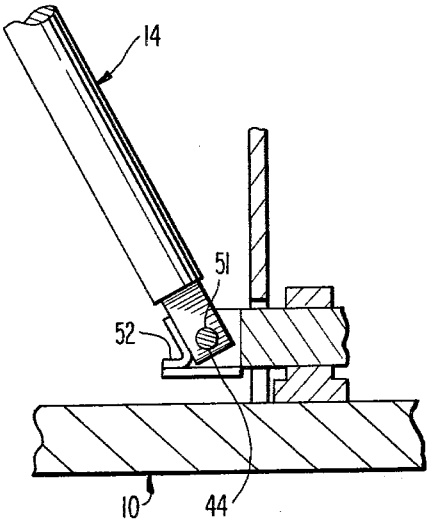
FIG. 6 is an enlarged, framentary front view of a portion of the mechanical arm wrestler of FIG. 1.
Figure 7:
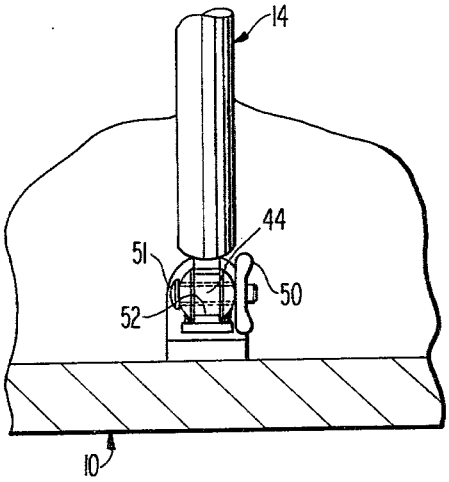
FIG. 7 is an enlarged, fragmentary side view of the portion of the mechanical arm wrestler shown in FIG. 6.

The crank arm 14 is pivotably mounted on the base 10 in bearings 34. As may be best seen in FIG. 4, it comprises a first portion 36 extending between the air cylinder 12 and the base 10 in a direction transverse to the motion of the rod 32, second portions 38 connected to the first portion 36 at either end and extending to a point 40 remote from the base 10 and in a plane perpendicular to the base 10 and containing the first portion 36 when the arm wrestler is in its ready condition, third portions 42 connected to the second portions 38 at their ends remote from the first portion 36 and extending from the point 40 to a point 44 adjacent the base 10 and in the previously mentioned plane when the arm wrestler is in its ready condition, and fourth portions 46 which are approximately the length of a human forearm, which are connected to the third portions 42 at their ends remote from the second portions 38, and which extend from the point 44 to a point 48 remote from the base 10 and in the previously mentioned plane when the arm wrestler is in its ready condition. As is best seen in FIGS. 6 and 7, the crank arm 14 is preferably made in three pieces pivotably joined at axes through the points 44 to permit the fourth portions 46, which are the mechanical arm's forearms, to pivot slightly in the direction perpendicular to the direction of play to allow the user of the arm wrestler to preset the fourth portion 46 with which he is to wrestle to a comfortable angle. Wing nuts 50 are provided on the bolt 51 which constitutes the axis to maintain the pre-selected angle, and stops 52 are provided on the fourth portions 46 to keep them from flopping down to the plane of the base 10 when the wing nuts 50 are not tightened down. Preferably also the second and third portions 38 and 42 each comprise as shown a first subportion which is perpendicular to the base 10 when the arm wrestler is in its ready condition and a second subportion which is parallel to the base 10 at all times, but the crank arm 14 could obviously be made in other shapes - for instance, with the second and third portions 38 and 42 joined in a V-shape rather than in a U-shape. Also, the ends of the fourth portions 46 adjacent the points 48 can be made in the shape of a human hand and can even be provided with an articulated "wrist" to give added realism. Moreover, collars 53 made of hard rubber or the equivalent are preferably provided on one or both of the fourth portions 46 to positively limit angular movement of the crank arm 14 to protect the user's hand.

Figure 4:
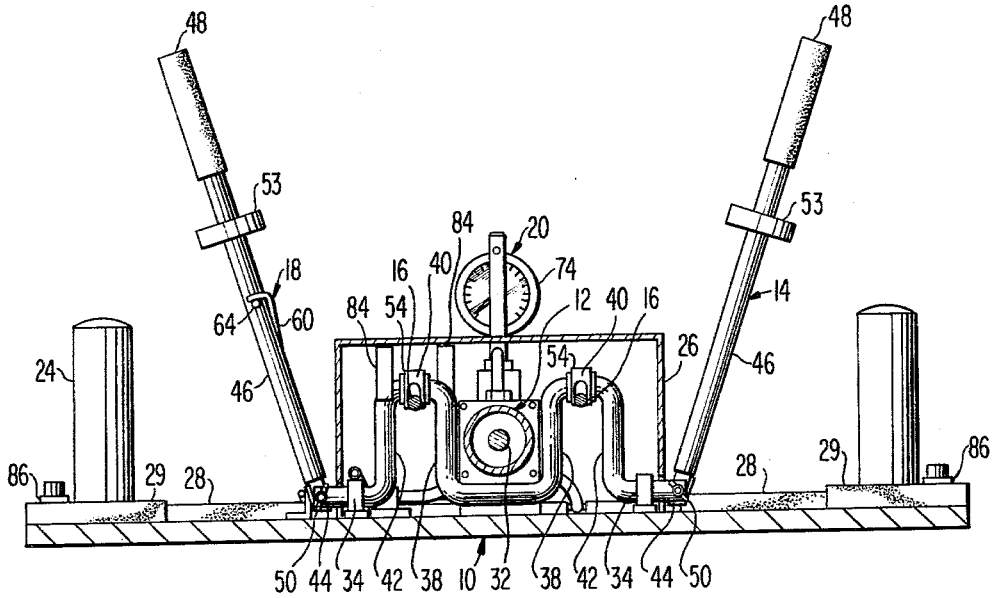
FIG. 4 is a view along line 4—4 in FIG. 2.
Figure 2:
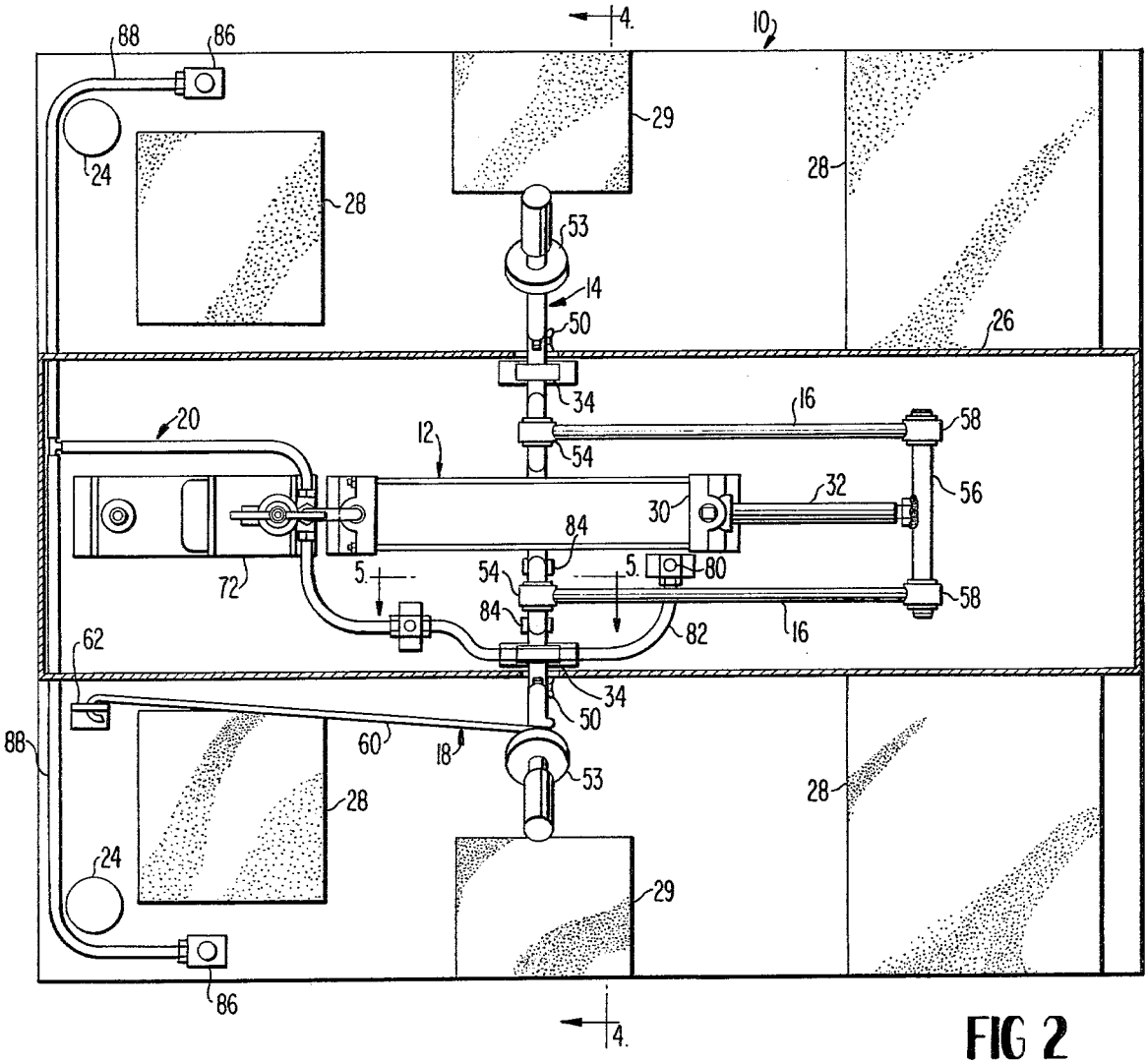
FIG. 2 is a sectional plan view of the mechanical arm wrestler of FIG. 1.

As best seen in FIGS. 2 and 4, an example of the connecting means is the rods 16 which are pivotably connected to the crank arm 14 via bearings 54 at the point 40. The arm wrestler preferably further comprises a brace 56 mounted on the rod 32 and extending in the direction transverse to the motion of the rod 32. The rods 16 are pivotably connected to the brace 56 via bearings 58 and lie in a plane perpendicular to the base 10 and to the first portion 36. The brace 56 preferably extends on both sides of the rod 32 as shown, and the device is symmetrical with respect to a plane of symmetry perpendicular to the base 10 and containing the rod 32 so that it can conveniently be used by either a right-handed or a left-handed player.

Figure 3:
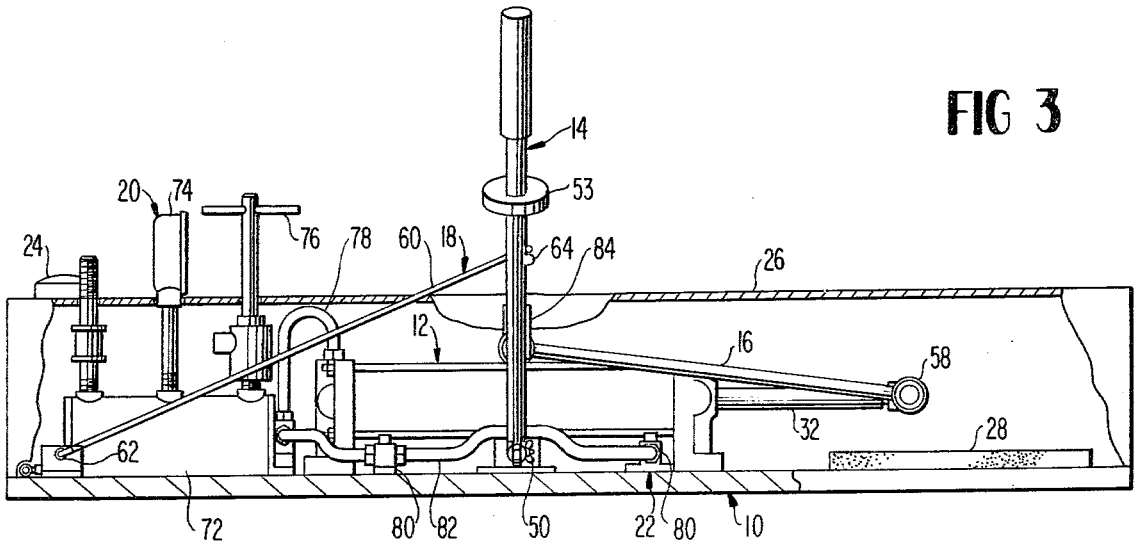
FIG. 3 is a side sectional view of the mechanical arm wrestler of FIG. 1.
Figure 5:
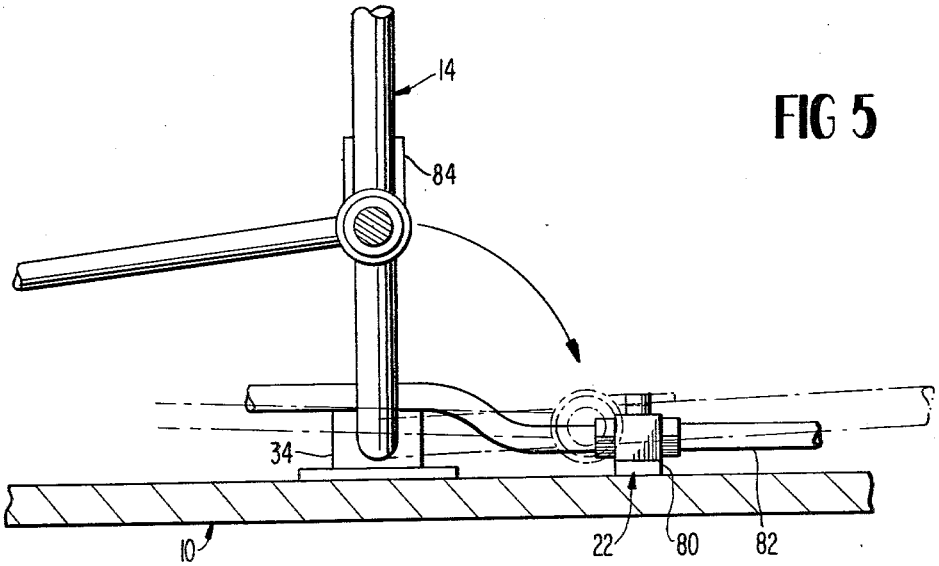
FIG. 5 is a view along line 5—5 in FIG. 2.

The means 18 for releasably holding the crank arm 14 in the ready condition can take on many different forms. As exemplary of such forms, a latch 60 pivotably mounted on the base 10 at 62 and a peg 64 on the adjacent one of the fourth portions 46 are shown. The latch 60 holds the crank arm 14 in the ready condition, and the peg 64 prevents the latch 60 from sliding down the crank arm 14. However, when the crank arm 14 is pivoted fractionally counterclockwise in FIG. 3 during play, the latch 60 drops to the base 10, thereafter permitting the crank arm 14 to pivot clockwise to the full extent of its travel.

The means 20 for providing a preselected air pressure in the air cylinder 12 can vary widely depending on the use to which the device is to be put. If, for instance, it is to be used as a coin-operated device in a "penny arcade" or the like, it could be a fairly elaborate subsystem hooked up to a central source of compressed air or to a compressed air pump. The illustrated embodiment, however, is designed primarily for "at home" use, and it employs simple, inexpensive, but sturdy components for this structure. These elements comprise a foot-operated air pump 66, such as the "Ram Pump" manufactured by the Ram Division of Intermarket, Inc., an air line 68 leading from the air pump 66 to a releasable one-way valve 70, a pressure reservoir 72, a pressure meter 74 (which is preferably calibrated in foot-pounds needed to overcome the torque exerted by the fourth portions 46 of the crank arm 14 rather than in the pressure inside the air cylinder 12), a manually operable pressure release valve 76, and an air line 78 leading from the pressure reservoir 72 to the air cylinder 12. Of course, a separate pressure reservoir 72 is unnecessary if the air cylinder 12 itself has a sufficient reservoir capacity, and the pressure reservior 72 can be cubical in shape or set at right angles to the air cylinder 12 in order to save space inside the cover 26. In use, the manually operable pressure release valve 76 is preferably set to a value just above that selected for each wrestling. (Alternatively, the manually operable pressure release valve 76 can be replaced by a pressure release valve which automatically adjusts itself to a value just above the pressure value present in the air cylinder 12 at the beginning of each use of the arm wrestler.) Then, as the user forces the crank arm 14 counterclockwise in FIG. 3, the piston 30 moves inwardly, compressing the air and beginning to increase the torque exerted by the cylinder 12 on the crank arm 14. However, the manually operable pressure release valve 76 is set to vent such over-pressure, and the pre-selected torque remains constant. On the other hand, as the air cylinder forces the crank arm 14 clockwise in the illustrated embodiment, the piston 30 moves outwardly, decompressing the air and decreasing the torque exerted by the air cylinder 12 on the crank arm 14, facilitating the user's task in fighting the arm back to the angular position where it started moving clockwise. (Of course, in a more elaborate device it would be possible to automatically compensate for the decompression of the air, maintaining a constant pressure regardless of the angular position of the crank arm 14.)

The means 22 for venting the air in the air cylinder 12 when the crank arm 14 has pivoted from its ready condition by a pre-determined amount can also take on many different forms. However, in the exemplary device shown in the drawings it comprises two quick-release, plunger-operated dump valves 80 mounted on an air line 82 in indirect communication with the air cylinder 12, two actuating toggles 84 mounted on the crank arm 14 inside the removable cover 26 in position to actuate the dump valves 80 when the crank arm 14 has pivoted from its ready condition by a pre-determined amount (which need not be equal) in either direction, and two quick-release, plunger-operated dump valve 86 mounted on air lines 88 in indirect communication with the air cylinder 12. The dump valve 86 are thumb operated (and may, accordingly, conveniently be placed on top of the bracing post 24, in which case the air lines 88 are fed up through the body of the bracing posts 24) and are provided to be operated both when the user gives up in the middle of a contest and when it is desired to reset the arm wrestler after having won. (The latter use is necessitated by that fact the air must be admitted into the air cylinder 12 in order to easily return the crank arm 14 to its upright condition. Accordingly, the dump valves 86, in contrast to the dump valves 80, should be two-way valves.)

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. A mechanical arm wrestler for supplying a continuous wrestling force comprising:

(a) a base;

(b) a fluid cylinder for providing a continuous force mounted on said base, said fluid cylinder having a piston therein, and a first rod carried by said piston and extending from one end of said cylinder;

(c) a crank arm pivotally mounted on said base;

(d) connecting means between said crank arm and said first rod;

(e) first means for releasably engaging said crank arm in a first condition;

(f) second means for providing a preselected pressure in said fluid cylinder for pressurizing said cylinder prior to releasing said crank arm; and (g) third means for venting the fluid in said fluid cylinder when said mechanical arm wrestler is in a second condition wherein said crank arm has pivoted to within a pre-determined distance from said base, (h) whereby the pressure in said cylinder exerts a continuous force first against the first means for releasably engaging the crank arm prior to release of the crank arm and second after release thereof against the crank arm when a force by the user is exerted to resist pivotal movement of the crank arm during an arm exercise program.

2. A mechanical arm wrestler as claimed in claim 1, wherein said connecting means comprises a second rod pivotally connecting a first point on said crank arm to said first rod.

3. A mechanical arm wrestler as claimed in claim 1, and further comprising fourth means for venting the pressure in said fluid cylinder when it exceeds the preselected pressure in said fluid cylinder by a preselected amount during use of the arm wrestler.

4. A mechanical arm wrestler as claimed in claim 1, wherein said third means for venting the fluid comprises quick release plunger operated dump valves and actuating toggles mounted on the crank arm.

5. A mechanical arm wrestler mechanism comprising in combination:

(a) a means for supplying compressed air which is under preselected pressure;

(b) a fluid cylinder connected to said means for supplying compressed air, said cylinder having a piston and a rod carried by said piston and extending from one end of said cylinder;

(c) a crank arm connected to said rod;

(d) means for releasably engaging said crank arm through an arm engaging member in a ready condition while the cylinder is being pressurized by said means for supplying compressed air;

(e) whereby said compressed air in said cylinder exerts a continuous force against the means for releasably engaging prior to release of said arm and after release thereof said force acts continuously against the arm of a wrestler against which a user applies a counter force during an arm exercise program.

6. A mechanical arm wrestler comprising:

(a) a base;

(b) a fluid cylinder mounted on said base, said fluid cylinder having a piston therein and a first rod carried by said piston and extending from one end of said cylinder;

(c) a crank arm pivotally mounted on said base, said crank arm comprising:

(i) a first portion extending between said fluid cylinder and said base in the direction transverse to the motion of said first rod;

(ii) a second portion connected to said first portion and extending to a first point remote from said base and in a plane perpendicular to said base containing said first portion when the mechanical arm wrestler is in a first condition;

(iii) a third portion connected to said second portion and extending from said first point to a second point adjacent said base and in said plane when the mechanical arm wrestler is in the first condition; and (iv) a fourth portion connected to said third portion and extending from said second point to a third point remote from said base and in said plane when the mechanical arm wrestler is in the first condition; said fourth position being approximately the length of a human forearm;

(d) a second rod pivotably connecting said first point on said crank arm to said first rod;

(e) first means for releasably holding said crank arm in said first condition;

(f) second means for providing a preselected pressure in said fluid cylinder; and (g) third means for venting the fluid in said fluid cylinder when said mechanical arm wrestler is in a second condition wherein said first point has pivoted to within a pre-determined distance from said base.

7. A mechanical arm wrestler as recited in claim 6 wherein said second means comprise a reservoir for compressed air carried by said base and means for transmitting compressed air from said reservoir to said fluid cylinder.

8. A mechanical arm wrestler as recited in claim 6 wherein said second and third portions both comprise a first subportion which is perpendicular to said base when the mechanical arm wrestler is in said first condition and a second subportion which is parallel to said base when the mechanical arm wrestler is in both said first and second conditions.

9. A mechanical arm wrestler as recited in claim 6 wherein said fourth portion is angled away from the direction of motion of said cylinder in said first plane when the mechanical arm wrestler is in the first condition.

10. A mechanical arm wrestler as recited in claim 6 and further comprising a brace mounted on said first rod and extending in the direction transverse to the motion of said first rod, said second rod being pivotably connected to said brace and lying in a second plane perpendicular to said base and to said first plane, said crank arm further comprising fourth, fifth, and sixth portions which are the mirror images of said first, second, and third portions, respectively, with respect to a plane of symmetry parallel to said second plane and containing said first rod.

11. A mechanical arm wrestler as recited in claim 10 wherein said second and third portions both comprise a first subportion which is perpendicular to said base when the mechanical arm wrestler is in said first condition and a second subportion which is parallel to said base when the mechanical arm wrestler is in both said first and second conditions.

12. A mechanical arm wrestler as recited in claim 10 wherein said fourth portion is angled away from the direction of motion of said cylinder in said first plane when the mechanical arm wrestler is in said first condition.

13. A mechanical arm wrestler as recited in claim 6 wherein said fourth portion is pivotably mounted on said third portion.

14. A mechanical arm wrestler as recited in claim 6 and further comprising fourth means for venting the pressure in said fluid cylinder when it exceeds the preselected pressure in said fluid cylinder by a preselected amount during use of the arm wrestler.

* * * * *